US005271553A

United States Patent [19]

Kim

[11] Patent Number: 5,271,553

[45] Date of Patent: Dec. 21, 1993

[54] RE-MAILABLE ENVELOPE WITH REMOVABLE ADDRESSING SHEET

[76] Inventor: Myun Ho Kim, 885 9th Ave., Apt. 2G, New York, N.Y. 10019

[21] Appl. No.: 866,429

[22] Filed: Apr. 10, 1992

Related U.S. Application Data

[63] Continuation-in-part of Ser. No. 695,205, May 3, 1991, abandoned.

[51] Int. Cl.[5] ..... B65D 27/06

[52] U.S. Cl. ..... 229/303; 229/304; 229/305

[58] Field of Search ..... 229/300, 301, 302, 303, 229/304, 305

[56] References Cited

U.S. PATENT DOCUMENTS

| | | | |
|---|---|---|---|
| 192,522 | 6/1877 | Marshall . | |
| 365,890 | 7/1887 | Weaver | 229/305 |
| 827,208 | 7/1906 | Boston | 229/305 |
| 1,128,862 | 2/1915 | Fitzsimmons | 229/309 |
| 1,151,442 | 8/1915 | Crull | 229/305 |
| 1,180,981 | 4/1916 | Cufal | 229/305 |
| 1,245,447 | 11/1917 | Felenchak | 229/301 X |
| 1,470,051 | 10/1923 | Ashby | 229/305 |
| 1,561,454 | 11/1925 | Ashby | 229/305 |
| 1,960,054 | 5/1934 | Johnson | 229/303 X |
| 2,396,543 | 3/1946 | Velazquez | 229/309 |
| 2,964,233 | 12/1960 | Forland | 229/302 |
| 3,111,257 | 11/1963 | Peach | 229/302 |
| 3,270,448 | 9/1966 | Donovan | 229/302 |
| 3,392,908 | 7/1968 | Shelley et al. | 229/309 |
| 3,512,702 | 5/1970 | Pritchard, Jr. | 229/71 |
| 3,558,040 | 1/1971 | Krueger | 229/302 |
| 3,652,007 | 3/1972 | MacDougall | 229/304 |
| 3,653,585 | 4/1972 | Kazaros . | |
| 3,693,869 | 9/1972 | Eaves, Jr. | 229/302 |
| 3,946,938 | 3/1976 | Kranz | 229/305 |
| 4,194,631 | 3/1980 | Rangan | 229/302 |
| 4,565,317 | 1/1986 | Kranz | 229/302 |
| 4,795,035 | 1/1989 | Kim . | |
| 5,025,980 | 6/1991 | Blackman . | |
| 5,035,329 | 7/1991 | Kim | 229/309 |

FOREIGN PATENT DOCUMENTS

| | | | |
|---|---|---|---|
| 0070729 | 3/1950 | Denmark | 229/302 |
| 711690 | 10/1941 | Fed. Rep. of Germany | 229/71 |
| 2394460 | 2/1979 | France | 229/302 |
| 0029907 | of 1913 | United Kingdom | 229/305 |
| 118376 | 8/1918 | United Kingdom . | |
| 2101528 | 1/1983 | United Kingdom . | |
| 2179324 | 3/1987 | United Kingdom . | |

*Primary Examiner*—Allan N. Shoap
*Assistant Examiner*—Jes F. Pascua
*Attorney, Agent, or Firm*—Schweitzer Cornman & Gross

[57] ABSTRACT

A re-mailable envelope is provided with a bodily removable front cover and a closure flap arrangement providing first and second sealing areas for sealing to the back panel of the envelope during first and second mailings. The outer front cover and the main front panel of the envelope have aligned windows for displaying address information provided on the contents of the envelope. At destination, the first addressee bodily removes the entire front cover, along with the original postage, cancellations marks etc., and also opens the envelope in a way that leaves the sealing flap means intact, along with an adhesive area thereon for resealing of the envelope for its second mailing. The envelope is characterized by simplicity and economy of construction and ease of use. In one form, "round trip" postage is provided, which avoids the need for a removable front panel.

2 Claims, 3 Drawing Sheets

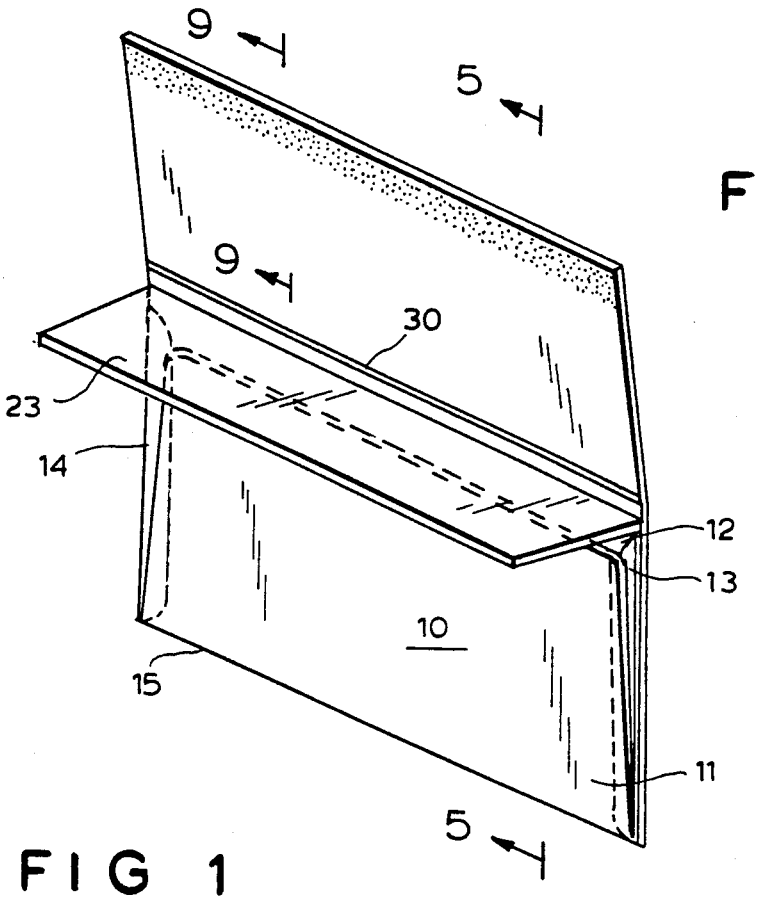
FIG. 2
FIG 1
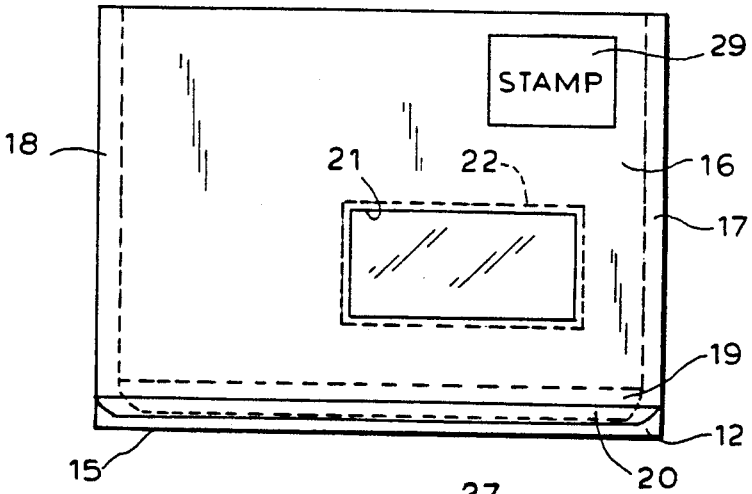
FIG. 9
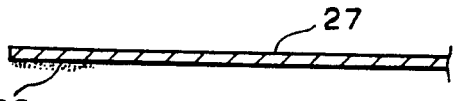
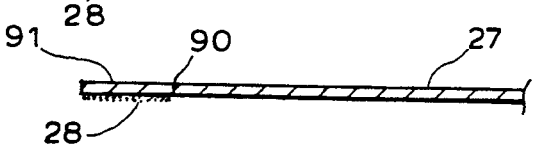
FIG. 10
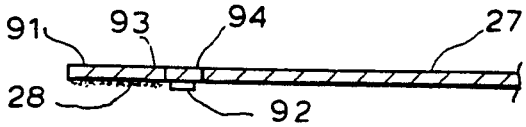
FIG. 11

RE-MAILABLE ENVELOPE WITH REMOVABLE ADDRESSING SHEET

RELATED APPLICATIONS

This application is a continuation-in-part of my copending application Ser. No. 695,205, filed May 3, 1991, now abandoned.

BACKGROUND AND SUMMARY OF THE INVENTION

The present invention is directed to a mailing envelope constructed to facilitate return mailing via the same envelope in which an original message is dispatched.

Multi-part envelope structures, designed to be reused by the original addressee for return to the original sender are in general well known. They are frequently used, for example, for sending of invoices, providing a convenient vehicle for return of payment to the sender. Known structures for this purpose, however, tend to be relatively complicated to construct and use, and frequently somewhat costly to manufacture. One example of such re-mailable envelopes is represented by the Blackman U.S. Pat. No. 5,025,980. That patent describes an envelope structure having a pair of overlapping closure flaps, one of which is used to seal the envelope for the first mailing, but is torn away by the addressee to gain access to the contents of the envelope. The second closure flap is folded over the opposite way and sealed to the opposite side of the envelope for return from the original addressee to the original sender. The prior art structures includes a tear-away front panel which carries the original address. Upon its removal, a window or other addressable area is exposed underneath.

The envelope structure of the present invention represents an improvement in the described prior envelope, both in terms of improved functionality, and in terms of economy of manufacture.

In accordance with the present invention, an envelope structure is provided, which includes primary front and back panels closed at their edges to form an envelope, and with a flap structure at the top for sealing the envelope. A removable address sheet is applied over the front panel and receives the address information, postage, etc. for direction to the first addressee. The first addressee can use the envelope for return or for the mailing by removing the outer front cover and utilizing the main front panel of the envelope for address information, postage etc. for the second addressee. A dual use flap structure is also provided to facilitate researling of the envelope for a second mailing.

While re-mailable envelopes are, in a general way, known in the prior art, the present invention provides an improved, simplified and more practical design, which is economical to manufacture and easy to use.

For a more complete understanding of the above and other features and advantages of the invention, reference should be made to the following detailed description of preferred embodiments and to the accompanying drawings.

DESCRIPTION OF THE DRAWINGS

FIG. 1 is a front view of one preferred version of the re-mailable envelope of the invention.

FIG. 2 is a perspective view of showing the back of the envelope of FIG. 1.

FIGS. 9–11 are fragmentary cross sectional views as taken generally on line 9—9 of FIG. 2.

DESCRIPTION OF PREFERRED EMBODIMENTS

Figure 3:
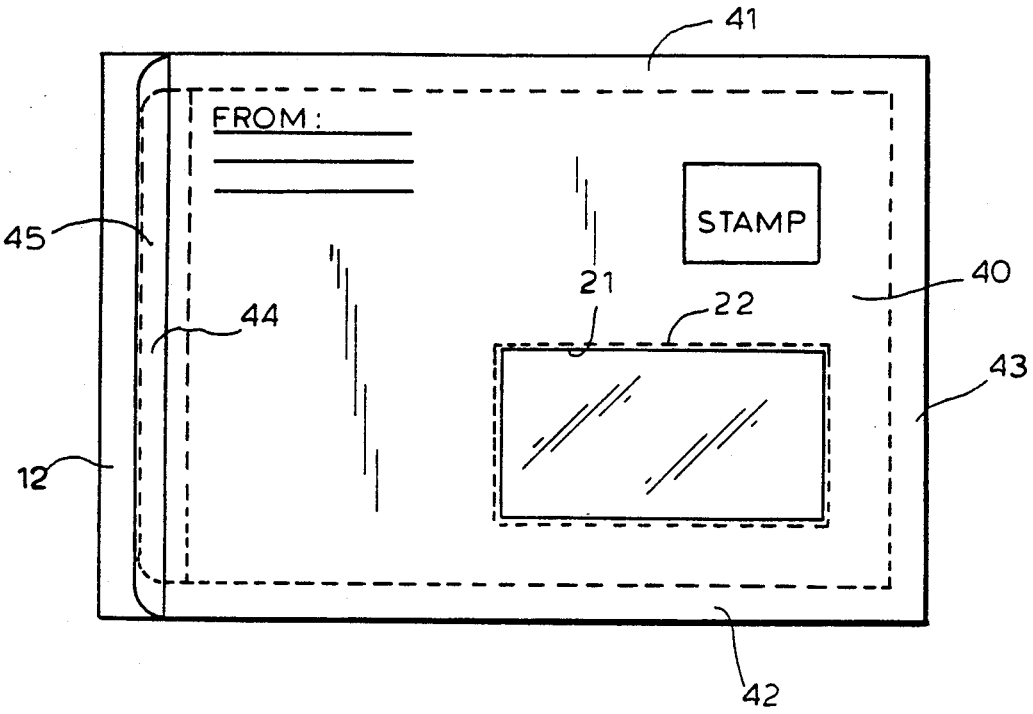
FIG. 3 is a front view of a modified form of the invention.

Referring now to the drawing, and initially to FIGS. 1 and 2 thereof, the reference 10 designates generally a remailable envelope according to the invention. In a typical construction, the envelope comprises a back wall panel 11, a main front wall panel 12, and opposite side glue flaps 13, 14. The front and back panels 12, 11 are connected along the bottom edge 15 in a more or less conventional manner.

In the envelope construction shown in FIG. 1, a second or outer front panel 16 is provided, and this is secured to the main or inner front panel 12 by adhesively bonded side margins 17, 18 and adhesively bonded bottom margin 19. Advantageously, the adhesively bonded margins are held in place by strips of a releasable adhesive, which may be of known type. Along the lower extremity of the outer front panel 16, there is provided a flap 20, all or at least a portion of which is free of adhesive to facilitate gripping for removal of the outer front panel. Alternatively, the dotted lines 17*a*, 18*a*, along the inner edges of the bonded side margins 17, 18, may serve as lines of weakness along which the front panel can be torn away.

As shown in FIG. 1, the front panel 16 is provided with an address area, most advantageously in the form of a window 21, which is aligned with a like window 22 formed in the inner or main front panel 12, allowing an address to show through from a document contained within the envelope.

Figure 5:
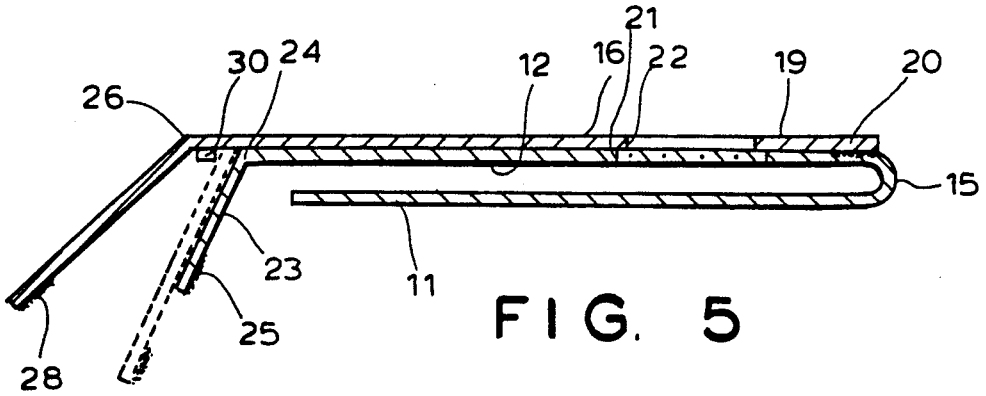
FIGS. 5–8 are cross sectional views as taken generally on line 5—5 of FIG. 2.

With reference to FIGS. 2 and 5, the main or inner front panel 12 is attached at its upper edge to a hinged closure flap 23 arranged to fold along an upper hinge line 24 to overlie the top of the back panel 11. A lower edge margin of the closure flap 23 is provided on its inside surface with an adhesive strip 25 which can be activated, when desired, to enable the flap 23 to be sealed to the back panel 11. Likewise, the outer front panel 16 is connected along a hinge line 26 at its upper extremity to a sealing flap 27, which is of greater length than the first mentioned sealing flap 23 and is provided along its outer marginal edge with an adhesive strip 28. The length of the flap is such that, when it is folded over flat against the back panel 11, it extends beyond the extremities of the inner flap 23, and the adhesive strip 28 lies below the lowest extremity of the flap 23 so as to be directly engageable with and sealable to the back panel 11.

For its initial mailing, the envelope of FIGS. 1, 2 and 5 would be filled with the desired contents, with an address showing through the windows 21, 22. The outer flap 27 would be sealed by its adhesive strip 28 to the back of the envelope 11. Suitable postage 29 (FIG. 1) is applied to the outer front panel 16 and the envelope is mailed to its destination. The first addressee, when opening the envelope, engages the lower flap 20 and removes the entire front panel 16 and back sealing flap 27. If desired, opening may be facilitated by providing a tear strip device 30 (FIG. 5) along the inside of the hinge line 26 and advantageously provided with a tear-away gripping tab 31 (FIG. 2). The tear strip element, when removed, enables the front panel 16 and back flap 27 to be removed separately.

When the front panel 16 and back flap 27 have been removed by the first addressee, the envelope is provided with a clean front surface arranged to receive new postage. When the return contents are inserted in the envelope, address information is visible through the inner window 22.

For re-mailing, the envelope is sealed by the second flap 23, hinged to the upper edge of the main front panel 12, which is now sealed to the back panel 11 by the adhesive strip 25.

In FIG. 3, there is shown a modified form of the invention, in which an outer front panel 40 is adhesively secured to the main or inner front panel 12 by upper and lower adhesive margins 41, 42 and opposite side adhesive margins 43, 44. At one side margin, a free flap 45 is provided. After the first addressee receives the envelope, it can be prepared for a re-mailing by gripping the outer front panel 40 by its free tab 45 at one side and peeling the panel off, from one side to the other.

Figure 7:
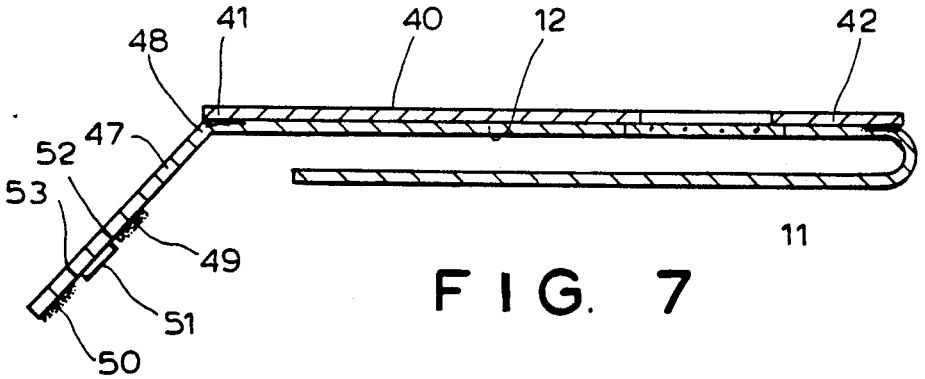

In one form of the FIG. 3 modification, shown in cross section in FIG. 7, the front panel 40 is a stand-alone panel, the removal of which does not affect other parts of the envelope. In the FIG. 7 modification, the sealing flap 47 is hinged at 48 to the top edge of the main front panel 12 and is arranged to be folded over and adhered to the back panel 11. Near its outer edge margins, the sealing flap 47 is provided with spaced-apart adhesive areas 49, 50, separated by a tear strip 51 straddled by lines of weakness 52, 53. The tear strip and lines of weakness extend laterally across the full width of the sealing flap.

To close the envelope modification of FIG. 7 for the first mailing, the flap 47 is folded over the back panel 11, and adhered thereto by the outermost adhesive strip 50. The envelope is opened by the first addressee, by pulling out the tear strip 51 to release the remainder of the flap for opening.

For re-mailing of the envelope, new address information and postage is provided on the main front panel 12, after removal of the outer front panel 40. The balance of the flap 47 is then refolded over the back panel 11 and is this time adhered to by the second adhesive strip 49. Special opening facilities are not required for the second addressee, as it is intended that the envelope will be destroyed after opening by the second addressee.

Figure 8:
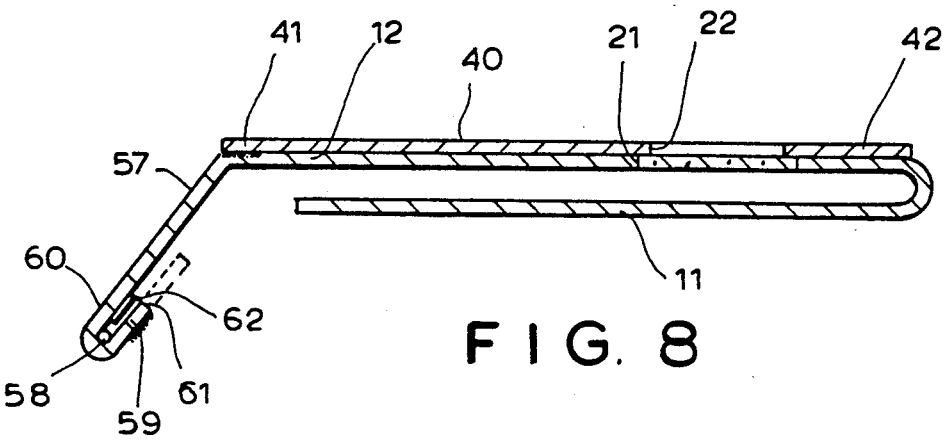

The modification of FIG. 8 is generally similar to that of FIG. 7, except for the construction of the closure flap 57. In the FIG. 8 modification, the outer or free end of the closure flap 57 is folded over along crease line 58 to provide an inner marginal portion 59 directly underlying an outer marginal portion 60. The respective marginal portions 59, 60 are formed with adhesive strips 61, 62 respectively. A tear string 63 is arranged in the bight fold to serve as an opening device. For the first mailing of the envelope of FIG. 8, the flap 57 is closed and sealed to the back wall 11 by moistening or otherwise activating the adhesive strip 61. When the envelope reaches the first addressee, it is opened by means of the tear string 63. This frees the flap from the adhesively secured margin 59 thereof, which remains attached to the panel 11. The flap 57 may then be folded back to gain access to the envelope.

When the envelope of FIG. 8 is re-mailed, its front panel is of course removed for new address information and postage, and the flap 57 is again folded over the back panel 11. The flap is sealed for the second mailing by activating the adhesive 62, which bonds to the outer surface of the original marginal section 59 of the flap, which remains secured thereto via the first adhesive strip 61.

Figure 6:
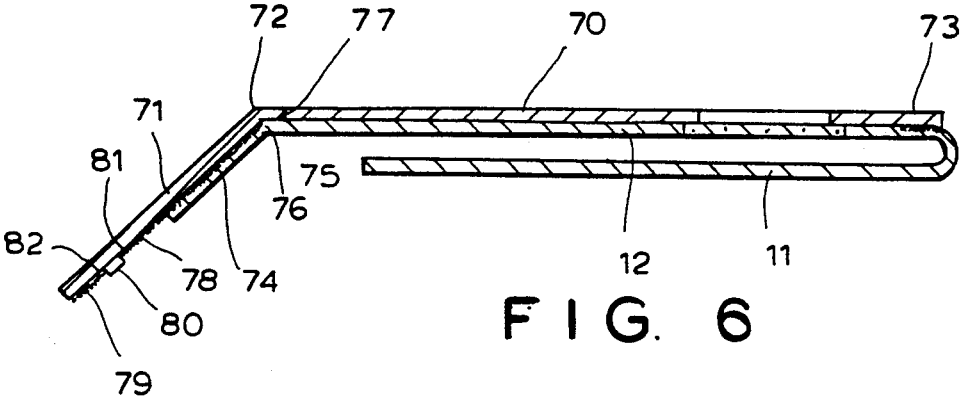

In the modification of FIG. 6, the outer front panel 70 is combined with a sealing flap section 71, being joined therewith along a hinge line 72. The modification of FIG. 6 is designed for side to side removal of the outer front panel 70, in the manner of FIG. 3. However, the outer panel 70 is adhesively bonded to the main front panel 12 along a bottom margin 73, opposite side edge margins (not shown but corresponding to 43, 44 of FIG. 3) and an adhesive area 74 which lies beyond the hinge line 72. The adhesive area 74 bonds the flap section 71 to a short stub flap 75, which is hinged at 76 to the upper edge of the main front panel 12. A line of weakness 77 (e.g. a perforated line) is provided along the upper edge of the outer front panel 70. The sealing flap 71 is provided along its outer margins with spaced adhesive strips 78, 79 separated by a tear strip 80 straddled by lines of weakness 81, 82, much in the manner described in connection with FIG. 7.

For its first mailing, the modification of FIG. 6 is closed by activating the outermost adhesive strip 79 and bonding it to the back panel 11. The envelope is opened by the first addressee, by tearing away the first tear strip 80, freeing the flap 71 for opening. The outer front panel 70 is removed by being peeled away side to side, in the manner of the FIG. 3 modification. In the arrangement illustrated in FIG. 6, the adhesive margin 73 advantageously is a pressure sensitive adhesive which allows the entire margin to be peeled away. At the upper edge, the front panel separates along the line of weakness 77.

The envelope of FIG. 6 is sealed for re-mailing by activating the second strip of adhesive 78 and securing it to the back face of the envelope back panel 11.

Referring now to FIGS. 9, 10 and 11, each of these shows a useful form of construction of the sealing flap 27, for use in the modification of FIG. 5. The FIG. 9 illustration conforms substantially to that of FIG. 5, wherein the flap 27 is arranged to be peeled away in its entirety, using a suitable pressure sensitive adhesive at 28. In FIG. 10, the flap 27 includes a line of weakness 90 along the inner edge of the adhesive strip 28, such that the flap 27 may be separated along the line of weakness, leaving an adhesive margin 91 remaining attached to the envelope. In the FIG. 11 version, in place of the line of weakness 90 of FIG. 10, there is provided a tear strip 92 straddled by lines of weakness 93, 94 in the flap 27. This enables the flap to be easily opened by gripping and pulling on the tear strip 92.

In any of its various forms, the re-mailable envelope provides a simple, expeditious and economical way of providing an envelope which can be used with convenience by the addressee for a second mailing, typically a return to the original sender. The arrangement of the invention provides for a removable outer front panel, which either contains (e.g., by a label), or allows viewing of, address information, and also contains postage, cancellation marks, etc. This front panel is bodily removed by the first addressee to condition the envelope for re-mailing.

Figure 4:
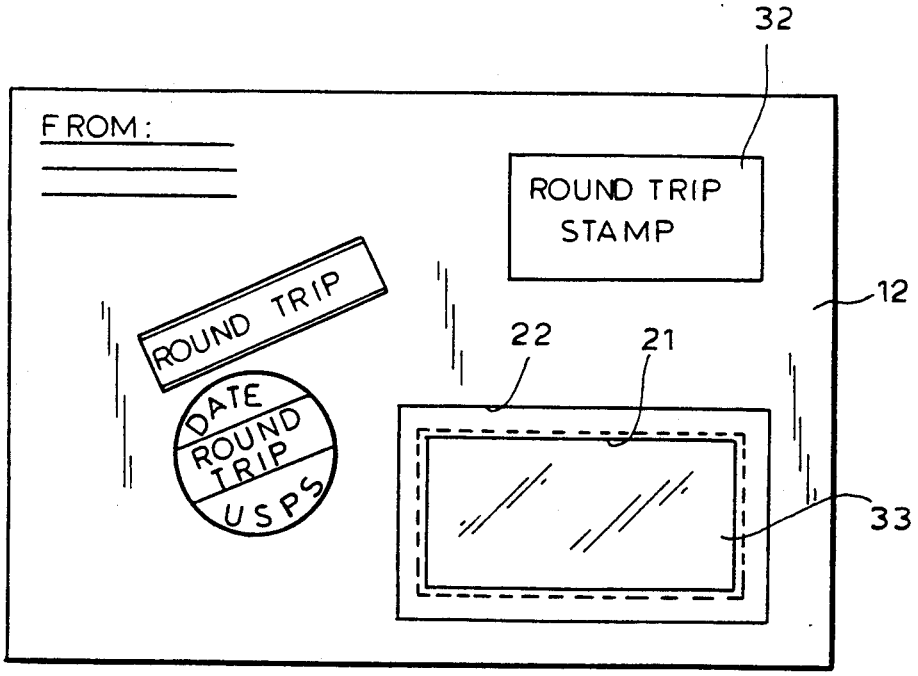
FIG. 4 is a view showing a novel form of reuseable envelope provided with "round trip" postage on its front panel.

In FIG. 4 there is shown another advantageous form of the invention, in which a reuseable envelope 110 is provided with a re-useable front panel 111 provided with special "round trip" postage 112 intended for double cancellation. To advantage, the front panel 111 of the envelope is provided with an address window 113, in which an address, indicated generally at 114 provided on the contents of the envelope, is visible. The sealing arrangements may, by way of example only, be of a type shown in FIGS. 7 and 8, in the form of a hinged sealing flap provided with spaced-apart, successively useable adhesive sealing areas.

When the envelope of FIG. 4 reaches its destination, the first-trip contents are removed, and the return contents are inserted in the envelope. Frequently, the return contents will be a portion of the first-trip contents, as will be understood. The return contents will be provided with address information in the area visible at 114 through the window 113. The envelope is resealed using the second adhesive strip (e.g. 49 in FIG. 7, 62 in FIG. 8). The "round trip" postage 112 provides for prepaid return postage to the return destination. By providing for "round trip" postage, it becomes unnecessary to provide a removable front panel for the envelope.

Instead of the viewing window 113, the envelope of FIG. 4 can be designed to present the first addressee information in other ways, such as by way of removable, peelable label, bearing first addressee information. Second addressee information could be printed on the front panel 11, underneath the peelable label, or presented through a viewing window initially covered by the peelable label, for example.

In a most advantageous form, aligned viewing windows are provided in the outer front panel and in the main front panel. However, it is possible to provide address areas, on which address information may be placed by hand or by preaddressed labels etc. In all versions of the invention, a fully removable front panel provides for the re-mailed envelope to be of quite conventional configuration, with a clean front face for postage and addressing. A variety of sealing flap arrangements are accommodated, including single flap arrangements provided with first and second adhesive areas, and dual flap arrangements, in which the first sealing flap is associated with the removable front panel and a second sealing flap is associated with the inner front panel. In all cases, the sealing flaps are closed by bonding to the back panel 11.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A re-mailable returnable envelope which comprises, a main front wall panel, a single back wall panel and a detachably removable cover panel, characterized by (a) said main front wall panel having upper, lower and opposite side edges and a portion comprising an address presenting area, (b) said back wall panel connected directly to said front wall panel along a hinge line and having upper, lower and opopsite side edges and an outer surface, (c) said removable cover panel having upper, lower and opposite side edges and being removably secured to said main front wall panel, (d) a portion of said removable cover panel comprising an address presenting area, (e) re-useable, sealable closure flap means extending from an upper edge of said envelope, (f) said closure flap means extending from a front upper edge poriton of said envelope to overlie the outer surface of said back panel and having first and second adhesive areas for securing said closure flap means to spaced apart respective first and second areas of said back wall panel outer surface to close said envelope for first and second mailings, (g) said first adhesive area being positioned farther from said upper edge portion than said second adhesive area such that when said closure flap means is closed for a first mailing, said first and second adhesive areas overlie different areas of said back panel outer surface and said first adhesive area is spaced from said second adhesive area, (h) tear line defining means in said closure flap means for separating a portion of said closure flap means including said first adhesive area from a portion of said closure flap means including said second adhesive area, (i) said cover panel being completely detached from said envelope body and said first adhesive area after a first mailing to expose said main front wall panel, (j) said envelope being openable after a first mailing by separating said closure flap means along said tear line defining means, and (k) said envelope being re-sealable for a second mailing by securing said second adhesive area of said closure flap means to said back wall panel outer surface.

2. A re-mailable envelope according to claim 1, further characterized by (a) said detachably removable cover panel being provided along opposed edges with adhesive margins secured to corresponding edge portions of said main front wall panel and enabling said cover panel to be completely detached by being engaged at one edge and peeled off of said main front wall panel after a first mailing, and (b) at least a portion of said closure flap means being attached directly to the upper edge of said main front wall panel.

* * * * *